US010090584B2

(12) United States Patent
Duan et al.

(10) Patent No.: US 10,090,584 B2
(45) Date of Patent: Oct. 2, 2018

(54) MINIATURE WIDEBAND ANTENNA FOR 5G MOBILE NETWORKS

(71) Applicant: University of Electronic Science and Technology of China, Chengdu, Sichuan (CN)

(72) Inventors: Zhaoyun Duan, Sichuan (CN); Fei Wang, Sichuan (CN); Xin Wang, Sichuan (CN); Zhanliang Wang, Sichuan (CN); Qing Zhou, Sichuan (CN); Xinyi Li, Sichuan (CN); Yubin Gong, Sichuan (CN)

(73) Assignee: University of Electronic Science and Technology of China, Chengdu, Sichuan (CN)

( * ) Notice: Subject to any disclaimer, the term of this patent is extended or adjusted under 35 U.S.C. 154(b) by 57 days.

(21) Appl. No.: 15/466,640

(22) Filed: Mar. 22, 2017

(65) Prior Publication Data

US 2017/0194720 A1 Jul. 6, 2017

(30) Foreign Application Priority Data

Dec. 16, 2016 (CN) ..... 2016 1 1167257

(51) Int. Cl.

| | |
|---|---|
| ***H01Q 21/00*** | (2006.01) |
| ***H01Q 1/36*** | (2006.01) |
| ***H01Q 1/48*** | (2006.01) |
| ***H01Q 1/24*** | (2006.01) |
| ***H01Q 1/52*** | (2006.01) |

(Continued)

(52) U.S. Cl.

CPC ..... *H01Q 1/36* (2013.01); *H01Q 1/243* (2013.01); *H01Q 1/48* (2013.01); *H01Q 1/521* (2013.01); *H01Q 9/40* (2013.01); *H01Q 15/0086* (2013.01); *H01Q 21/0006* (2013.01)

(58) Field of Classification Search

CPC ..... H01Q 21/061; H01Q 3/26; H01Q 1/246; H01Q 13/04

USPC ..... 343/893, 773, 895, 702

See application file for complete search history.

(56) References Cited

U.S. PATENT DOCUMENTS

| | | | | |
|---|---|---|---|---|
| 7,245,259 B2 * | 7/2007 | Puckey | ..... | H01Q 1/243 343/700 MS |
| 2005/0156804 A1 * | 7/2005 | Ratni | ..... | H01Q 9/28 343/773 |

(Continued)

*Primary Examiner* — Dameon E Levi
*Assistant Examiner* — Collin Dawkins

(57) ABSTRACT

The present invention provides a miniature wideband antenna for 5G, which includes a dielectric substrate, a coplanar waveguide feed structure on a front of the dielectric substrate, a main radiator, a second and third radiators and a first radiator on a back of the dielectric substrate. The antenna is small in size with operation band of 3 GHz-30 GHz which covers the various 5G frequency band and covers the current wireless modes of Wi-MAX, W-LAN, UWB and so on. The antenna guarantees future compatibility for various complicated communication modes and has good perspectives for many applications. Based on the antenna, the double-unit and four-unit MIMO antenna adopts orthogonal polarization and metamaterial unit. Thus, high unit separation is achieved without increase on the size of the antenna unit. The present invention has wide applications in small mobile device such as cell phone and laptop.

5 Claims, 7 Drawing Sheets

(51) Int. Cl.
*H01Q 9/40* (2006.01)
*H01Q 15/00* (2006.01)

(56) References Cited

U.S. PATENT DOCUMENTS

2005/0248499 A1* 11/2005 Park ..... H01Q 1/36
343/895
2008/0024366 A1* 1/2008 Cheng ..... H01Q 1/38
343/700 MS

* cited by examiner

MINIATURE WIDEBAND ANTENNA FOR 5G MOBILE NETWORKS

CROSS REFERENCE OF RELATED APPLICATION

This application claims priority under 35 U.S.C. 119(a-d) to CN 201611167257.1, filed Dec. 16, 2016.

BACKGROUND OF THE PRESENT INVENTION

Field of Invention

The present invention relates to antenna technology field, and more particularly to 5G ($5^{th}$ generation mobile networks) MIMO (Multiple-Input-Multiple-Output) antenna field and Metamaterial field.

Description of Related Arts

In recent years, with the continuous development of mobile communication and the pressing demand for high data rate, stable communication quality and various complicated applications, 5G has become one of the hottest research topics in the mobile communication industry in the world, such as Cisco and Intel of USA, Metis, 5GPP and NGMN of EU, ARM AdHoc of Japan, 5G Forum of Korea and IMT-2020 of China. Under the premise of reasonable instrument cost the booming demand for wireless communication brings a series of requirements for 5G, which are serving more clients, higher data rate, supporting unlimited connection and providing personalized experience. These requirements demand wider bandwidth, while the low frequency band (800 MHz-3 GHz) is occupied by various current communication formats. The current low frequency band spectrum resource is unable to fulfill the 5G requirement. The current research on 5G focuses on the spectrum resource over 3 GHz. In 2014, USA published the research on applying frequency band over 24 GHz to advanced mobile service, in which the suitable candidate frequency bands for 5G are publicly discussed and 12 frequency bands are chosen. In 2012, EU started the research on frequency allocation within the range of 6 GHz-100 GHz, spectrum allocation and spectrum usage and published reports on 5G spectrum requirement and principle for spectrum usage in 2013 and 2014, respectively. In 2015, UK published draft version to solicit opinions on the high-frequency resource for 5G within the industry and identified 6 potential 5G frequency band. In 2016, the Japanese operator NTT Docomo worked with Samsung Group to finish the related research on 5G under 28 GHz frequency band on high-speed railway, wherein the 28 GHz frequency band is one of the designated candidate frequency bands of the 5G network of the Ministry of Internal Affairs and Communications of Japan. In recent years, Korea submitted almost 10 candidate frequency bands for 5G over 6 GHz to international organizations. Under IMT-2020 frame, China carried out a series of research on 5G spectrum demand prediction, candidate frequency band selection, broadcasting property measuring of certain frequency bands and electromagnetic compatibility. Lead by China State Radio Monitoring Center and State Radio Spectrum Management Center an estimate for overall 5G spectrum demand toward 2030 is achieved and research on priority of 6 GHz-100 GHz candidate frequency band and so on are carried out. Recently, China further narrowed the 5G candidate high frequency range of 6 GHz-100 GHz with the consideration of the new research trends domestic and abroad. Besides, the Chinese 5G research teams such as China mobile and Huawei carried out research on the 5G instruments for frequency range around 3.5 GHz and successfully released related experimental prototype in 2016.

3 GHz-30 GHz frequency range is the key research direction and development trend for the future 5G. As an important part of the wireless communication, the research on 5G antenna will be challenged with various problems. 5G antenna is required to adopt various communication modes at the same time to meet the people's daily demands. Besides, the trend of reducing the size of mobile communication devices limits the size of the antenna extremely. How to realize ultrawide frequency bands of 3 GHz-30 GHz within limited space is a challenge for all the researchers. MIMO technology is becoming an indispensable part of the 5G antenna due to the high data rate and high communication quality required by the modern mobile communication. The antenna unit increase and separation required in MIMO technology bring further challenges for related research.

At present, the metamaterial as a kind of new artificial material has some exotic electromagnetic features such as negative permittivity, negative permeability and negative refractive index, which doesn't appear in the naturally occurring material. The metamaterial attracts wide attention and is well studied. When designing the MIMO antenna, the unit separation of antenna is effectively improved by adopting the metamaterial unit without damage on antenna performance, which reduces the size of the MIMO antenna and realizes the wideband. Obviously, the metamaterial is the hot research topic in the related fields.

SUMMARY OF THE PRESENT INVENTION

An object of the present invention is to provide a miniature wideband antenna for 5G by using related antenna technology, based on which the double-unit MIMO antenna is provided. In the mean time, by adopting metamaterial structure unit the four-unit MIMO antenna is proposed, which is able to achieve ultrawide operation band, small size, good omni-directional character, high unit separation and so on.

The technical solution adopted by the present invention is listed as follow:

A miniature wideband antenna for 5G as illustrated in FIG. 1, comprising: a dielectric substrate, a coplanar waveguide feed structure on a front of the dielectric substrate, a main radiator, a second radiator, a third radiator and a first radiator on a back of the dielectric substrate, wherein the coplanar waveguide feed structure comprises feed line and metal ground;

the metal ground is a wrap-around structure with a pentagon in a middle;

the main radiator is an improved rectangle monopole antenna, a bottom of which is an inverted trapezoid connected to the feed line; a top of the monopole antenna is a rectangle structure with ladder-shaped grooves;

the first radiator is an isosceles trapezoid set on the back of the dielectric substrate; a short side of the isosceles trapezoid is near to and parallel with a bottom of the metal ground;

the second and the third radiators are parallelograms set symmetrically beside two unparallel sides of the main radiator; the bottom of the second and the third radiators are near to and parallel with the metal ground; at an obtuse angle of a bottom of each of the parallelograms there is a groove in right trapezoid shape;

the pentagon in the middle of the wrap-around metal ground is formed by a rectangle and an isosceles triangle.

Furthermore, as illustrated in FIG. 3 a miniature wideband antenna is an antenna unit, two of which are placed orthogonally to form a double-unit MIMO antenna.

Furthermore, as illustrated in FIG. 7 four antenna units form a four-unit MIMO antenna; every two antenna units are placed symmetrically along each of two diagonals; the two antenna units along one of the diagonals are placed face-up and the rest two antenna units are placed face-down; on the metal ground of each of the four-unit MIMO antenna units a rectangle split-ring resonator is etched near a center of the overall four-unit MIMO antenna.

The present invention adopts a coplanar waveguide feed microstrip structure to reduce the size and integrate with other devices. The main radiator of the antenna adopts a monopole antenna to achieve wide operation band. Ladder-shaped grooves are etched at the top of the monopole antenna and the bottom of the main radiator is in a trapezoid shape, which further widens the operation band and realizes 3 GHz-20 GHz frequency band. Set a trapezoid-shaped radiator on the back of the antenna to further induce resonance radiation of high frequency band through energy coupling from microstrip feeding without affecting the performance of the monopole main radiator. Set wing-shaped structures symmetrically on the two unparallel sides of the main radiator to make the antenna operation band cover most of 3 GHz-30 GHz frequency band. The metal ground is wrap-around and symmetric with a pentagon in the middle, which is able to improve the overall antenna performance. As illustrated in FIG. 2, there is the operation band of 3 GHz-30 GHz.

The wideband 5G antenna in the present invention is in the size of 25 mm×25 mm×1 mm, which has an obvious miniature structure. The operation band of the antenna is 3 GHz-30 GHz, which covers the various current 5G frequency band and covers the current wireless modes such as Wi-MAX, W-LAN, UWB and so on. The antenna guarantees the compatibility for various complicated communication modes and has good perspectives for many applications. Based on the antenna, the present invention introduces the double-unit and four-unit MIMO antennas, which adopt orthogonal polarization and metamaterial structure unit. Thus, high unit separation is achieved without increase on the size of the antenna unit. The present invention has wide applications in small mobile devices such as cell phone and laptop.

BRIEF DESCRIPTION OF THE DRAWINGS

FIG. 1-2 is a perspective view of a back of a single antenna unit;

FIG. 2 is a simulated $S_{11}$ parameters graph of single antenna unit;

FIG. 6-1 is a simulated $S_{11}$ and $S_{21}$ parameters graph of four-unit MIMO antenna;

FIG. 6-2 is a simulated $S_{31}$ and $S_{41}$ parameters graph of four-unit MIMO antenna;

FIG. 8-1 is a simulated $S_{11}$ and $S_{21}$ parameters graph of four-unit MIMO antenna with split-ring resonators;

FIG. 8-2 is a simulated $S_{31}$ and $S_{41}$ parameters graph of four-unit MIMO antenna with split-ring resonators.

DETAILED DESCRIPTION OF THE PREFERRED EMBODIMENT

Figure 1:
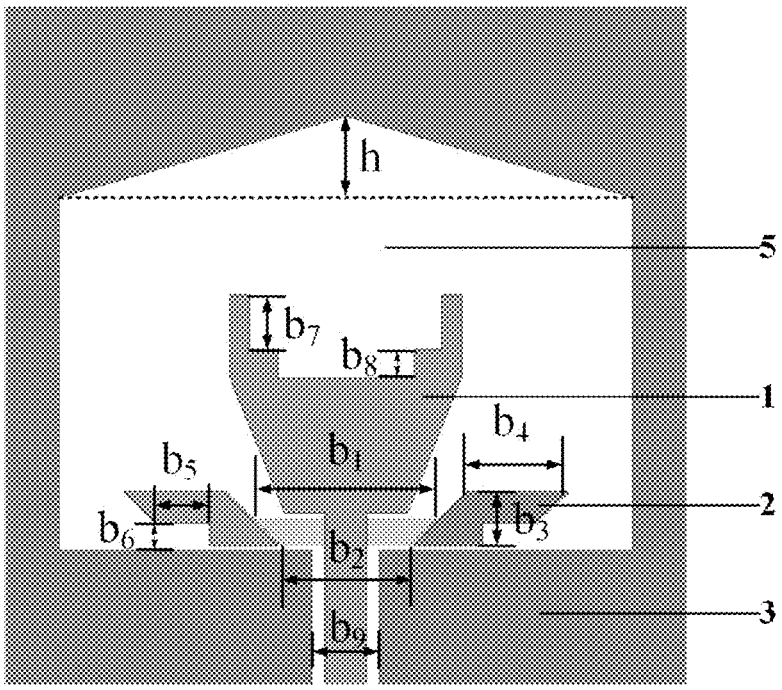
FIG. 1-1 is a perspective view of a front of a single antenna unit.

Referring to FIG. 1 to FIG. 8 of the drawings, according to a preferred embodiment of the present invention is illustrated, wherein FIG. 1 is the embodiment of the present invention. The overall structure of the antenna is bilateral symmetry and sized in 25 mm×25 mm×1 mm, which comprises a main radiator 1, a second radiator and a third radiator 2, a coplanar waveguide feed structure 3 set on the front of the dielectric substrate, a first radiator 4 and a rectangle dielectric substrate 5 set on the back of the dielectric substrate. The antenna dielectric substrate 5 is made of FR4 material with the relative permittivity of 4.4 and loss angle tangent of 0.02. The material of all the radiators and the coplanar waveguide feed structure is copper (other conductor is able to be selected such as aluminum, gold, and stainless steel depending on different situations) covered on the dielectric substrate. The coplanar waveguide feed structure comprises a feed line, a wrap-around symmetric ground structure with a pentagon in the middle, wherein the pentagon is formed by a rectangle and an isosceles triangle. The main radiator is a deformed rectangle monopole antenna, the top of which is a rectangle structure with ladder shaped grooves and the bottom of which is an inverted trapezoid structure connected to the feed line, wherein the width of the feed line is 2 mm.

Figures 1, 2:
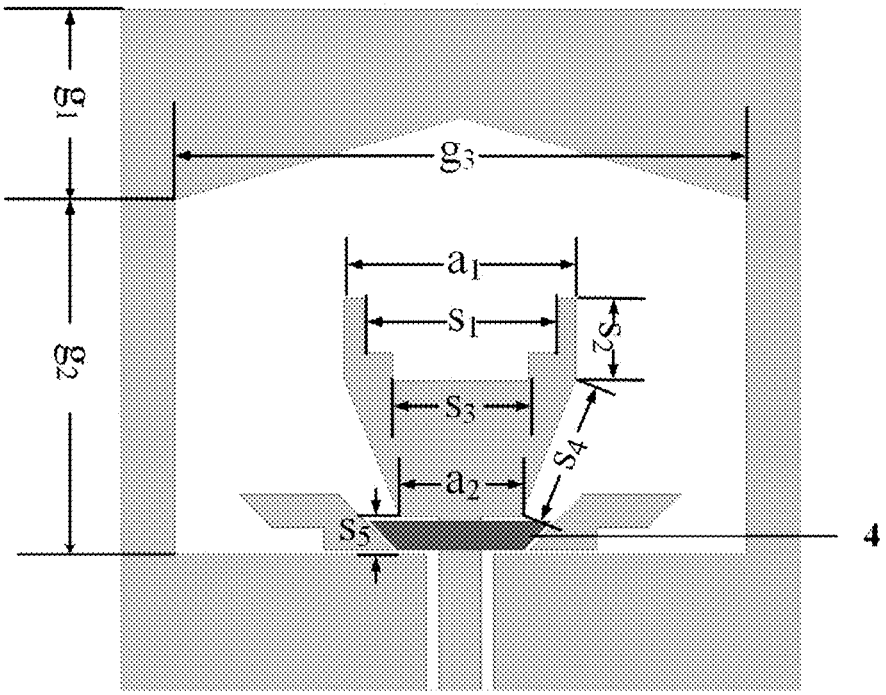
Figure 2:
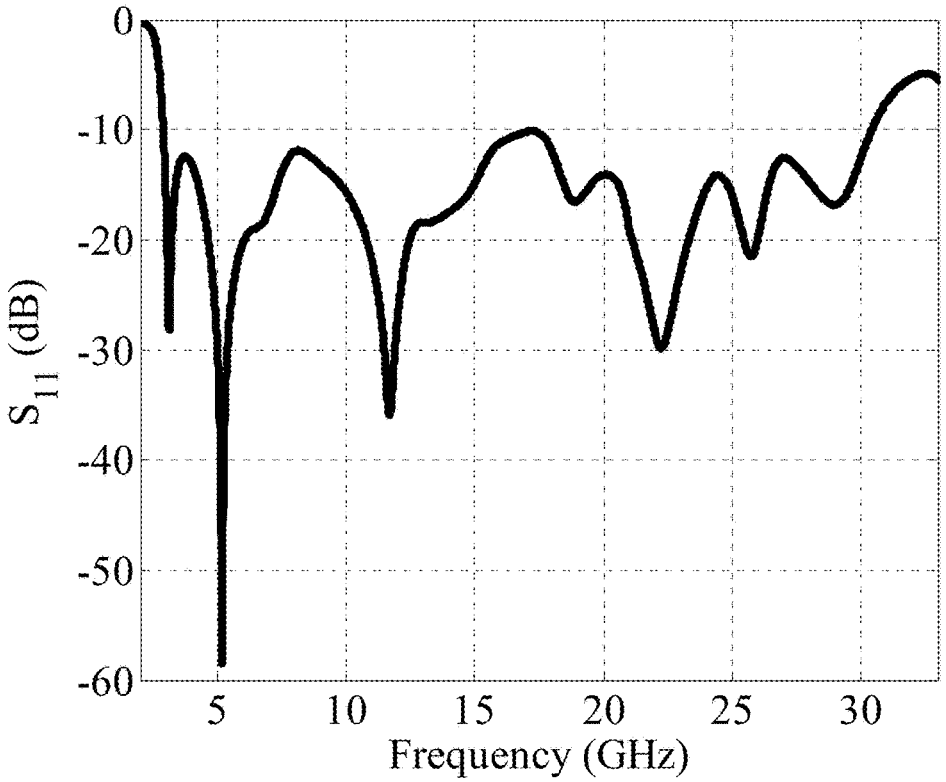

The second and the third radiators are a parallelogram structure, which is set symmetrically beside the two unparallel sides of the main radiator. The short side at the bottom of the second and the third radiator is near and parallel to the ground, wherein the gap between the radiator and the metal ground is 0.15 mm and at an obtuse angle of the bottom of each of the parallelograms there is a groove in right trapezoid shape;

The first radiator is an isosceles trapezoid structure set on the back of the dielectric substrate. The height of the first radiator is 1.2 mm. The short side of the first radiator is near and parallel to the bottom of the ground. The gap between the first radiator and the ground is 0.15 mm. The unparalleled sides of the first radiator are near and paralleled to a long sloping side of the second and the third radiators, respectively, wherein the gap between the first radiator and the long side of the second and the third radiators is 0.2 mm; the given size is shown in FIG. 1: $g_1$=4 mm, $g_2$=16 mm, $g_3$=20 mm, h=2 mm, $a_1$=10 mm, $a_2$=4 mm, $s_1$=8 mm, $s_2$=3 mm, $s_3$=6 mm, $s_4$=7 mm, $s_5$=2 mm, $b_1$=7 mm, $b_2$=5 mm, $b_3$=2 mm, $b_4$=3 mm, $b_5$=1.5 mm, $b_6$=1 mm, $b_7$=2 mm, $b_8$=1 mm, $b_9$=3 mm; FIG. 2 is the simulated $S_{11}$ parameter graph of the antenna structure, as shown in FIG. 1.

FIG. 2 shows that the operation band of the antenna in the present invention wholly covers the 3 GHz-30 GHz frequency band (corresponding to $S_{11}$<−10 dB), which is compatible to various communication modes and convenient for future related mobile communication devices.

Figure 3:
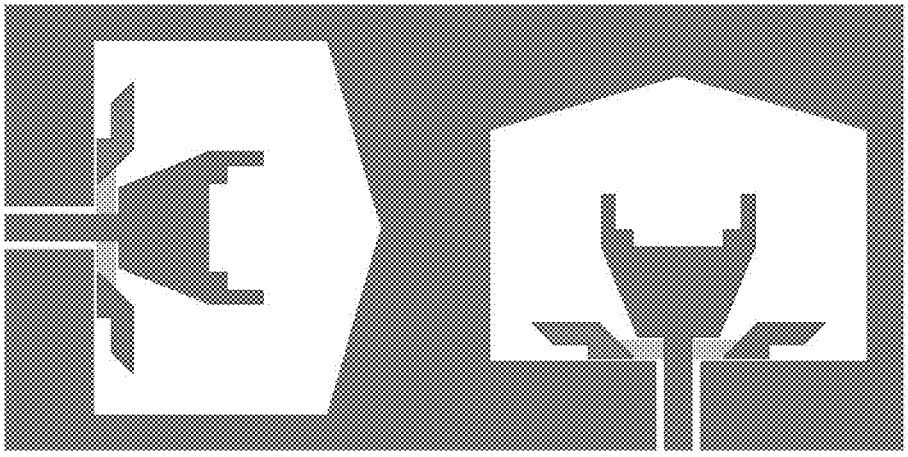
FIG. 3 is a perspective view of a double-unit MIMO antenna.
Figure 4:
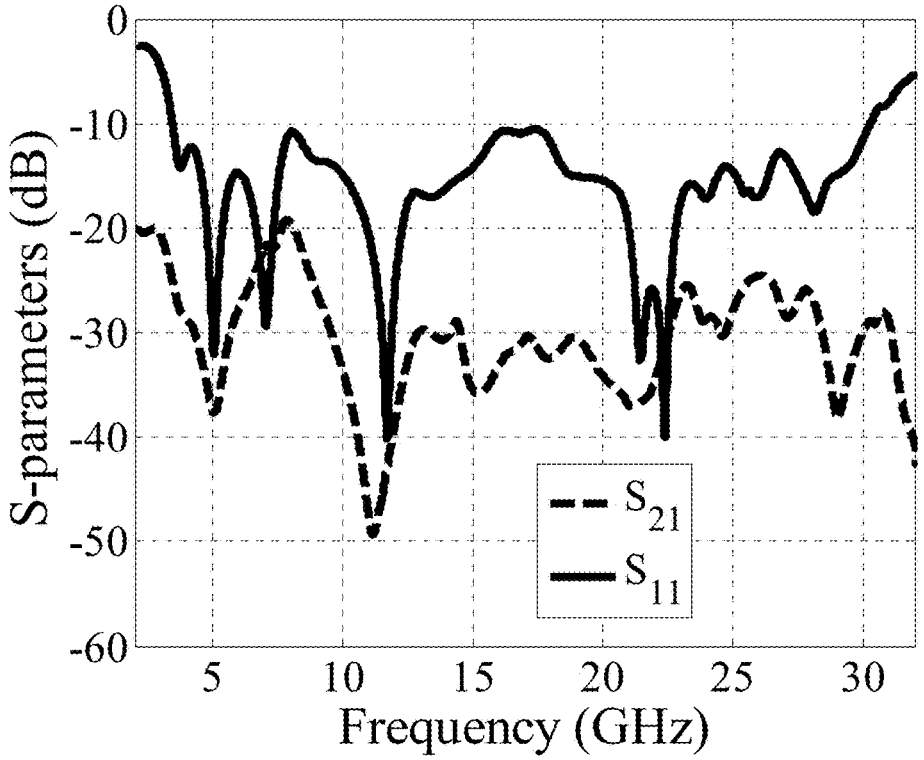
FIG. 4 is a graph of double-unit MIMO antenna.

Furthermore, using the antenna in the present invention as an antenna unit, two antenna units are placed orthogonally to form a double-unit MIMO antenna, as shown in FIG. 3. Rotates one of the antenna units for 90 degrees to make the polarized direction of the two antenna units orthogonal and guarantee the high isolation within extremely short distance. The simulated $S_{11}$ and $S_{21}$ parameters of the antenna are shown in FIG. 4. The antenna unit operates in the extremely wide frequency band of 3 GHz-30 GHz, while the $S_{21}$ parameter is below −20 dB within the whole operation band, which manifests the antenna units are well separated.

Figure 5:
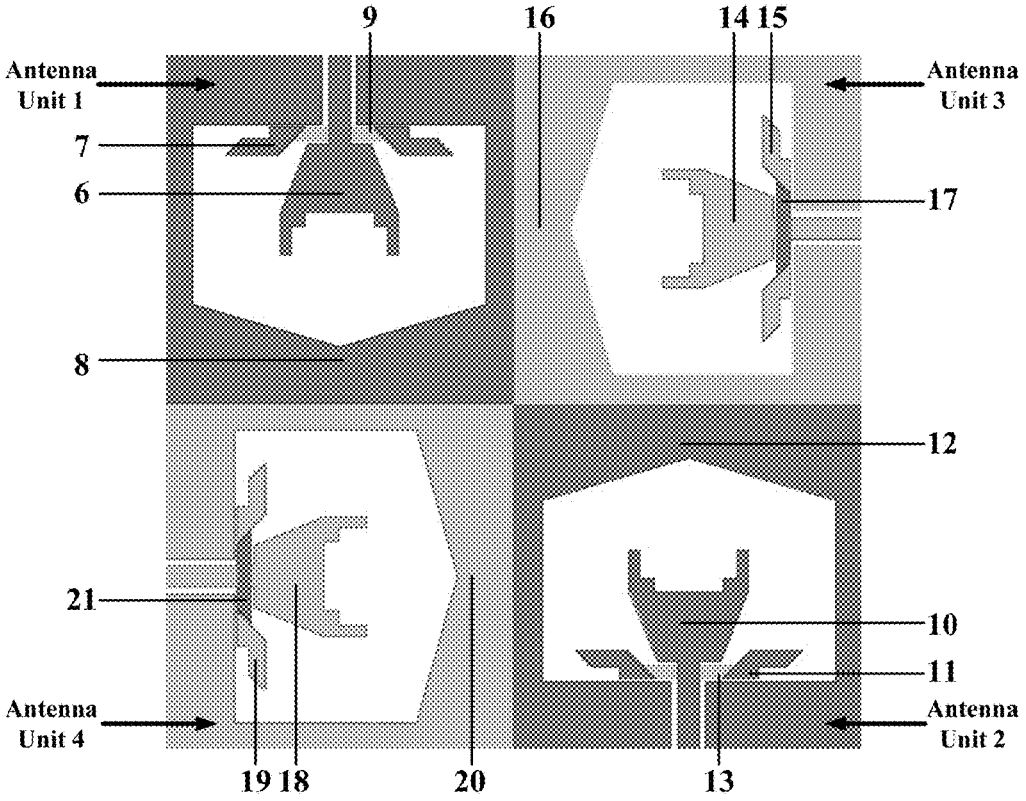
FIG. 5 is a perspective view of a four-unit MIMO antenna.
Figures 1, 6:
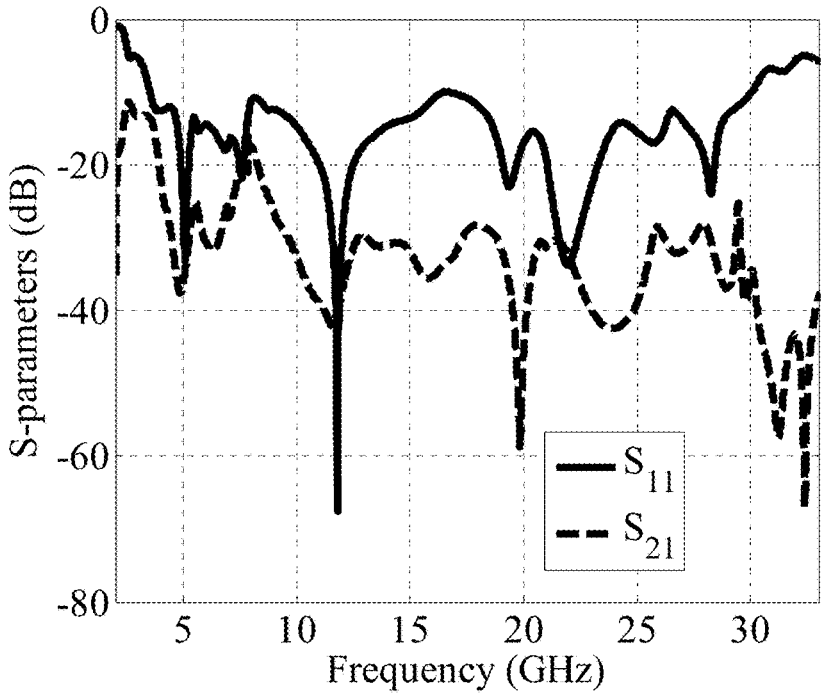
Figures 2, 6:
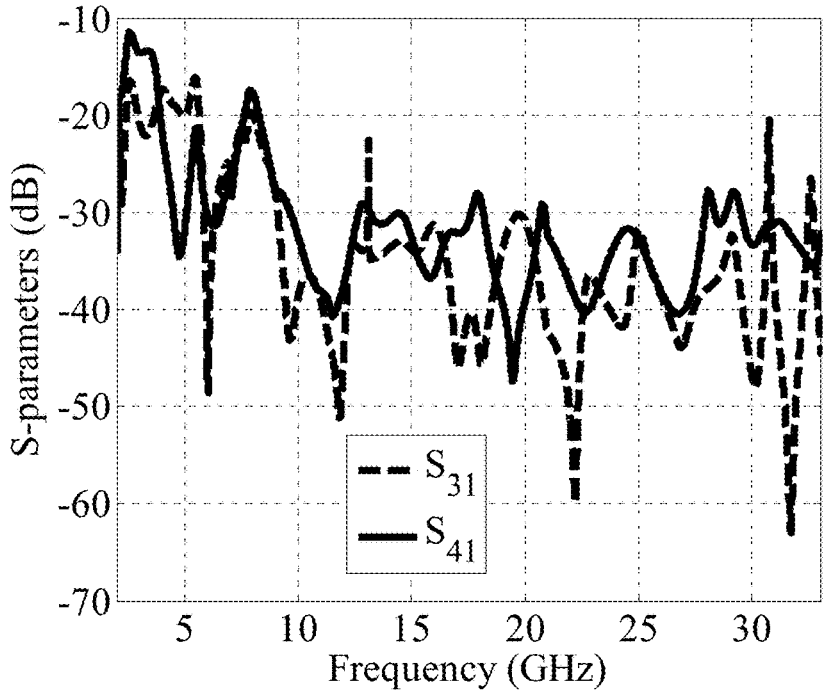

Furthermore, four antenna units form a four-unit MIMO antenna. Every two antenna units are placed symmetrically along each of two diagonals; the two antenna units along one of the diagonals are placed face-up and the rest two antenna units are placed face-down. The four-unit MIMO antenna structure is shown in FIG. 5, wherein the main radiator of antenna unit 1 and feed line 6, the second and the third radiators 7, the ground 8, the main radiator of the antenna unit 2 and the feed line 10, the second and the third radiator 11, the ground 12, the first radiator 17 of the antenna unit 3 and the first radiator 21 of the antenna unit 4 are integrated on the same side of the dielectric substrate. The main radiator of the antenna unit 3 and the feed line 14, the second and the third radiators 15, the ground 16, the main radiator of the antenna unit 4 and the feed line 18, the second and the third radiators 19, the ground 20, the first radiator 9 of the antenna unit 1 and the first radiator 13 of the antenna unit 2 are integrated on the other side of the dielectric substrate. The four-unit MIMO antenna is formed. The separation is greatly improved by cutting the coupling route of the two antenna units along one diagonal through turning the two antenna units at two sides of the dielectric substrate. FIG. 6 is the simulated S parameters graph of the four-unit MIMO antenna, as shown in FIG. 5, which shows that the separation of the antenna units is high in most of the operation band, while a strong coupling appears at frequencies (7 GHz-8 GHz).

Figure 7:
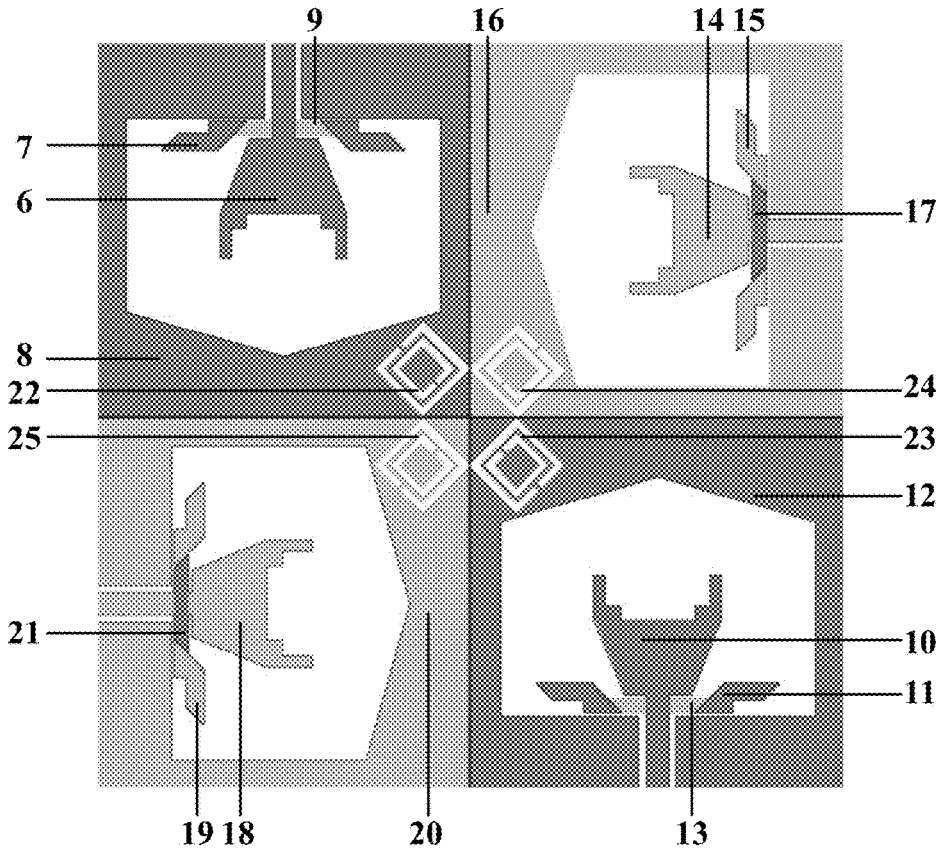
FIG. 7 is a perspective view of the four-unit MIMO antenna with split-ring resonators.
Figures 1, 8:
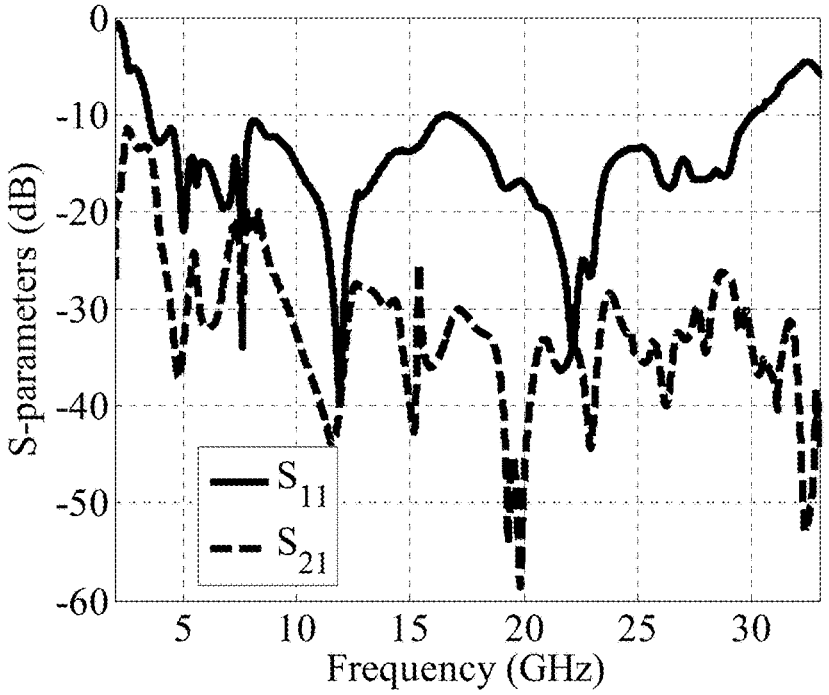
Figures 2, 8:
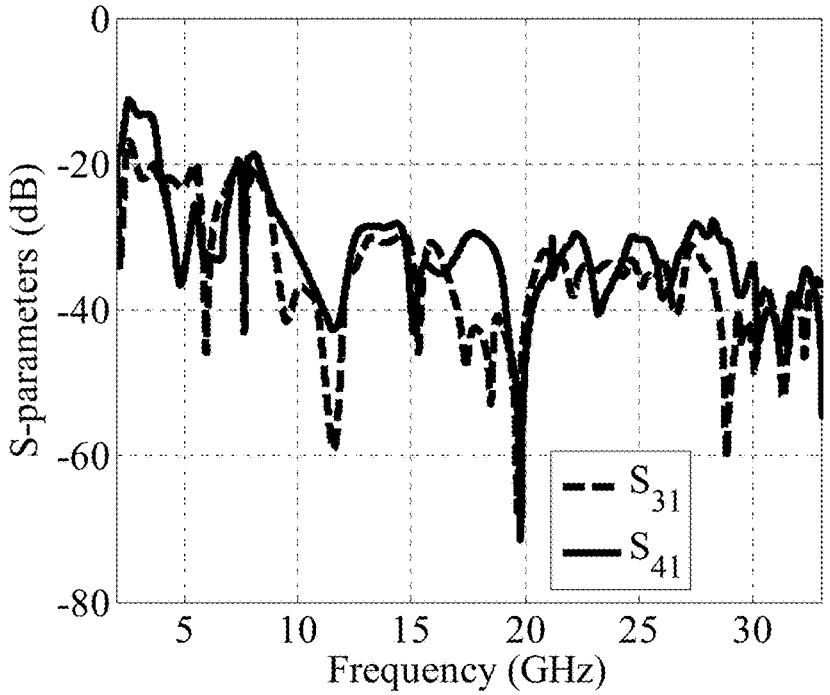

FIG. 7 is the MIMO antenna with the split-ring resonators, wherein based on the four-unit MIMO antenna (FIG. 5), the same-structured rectangle split-ring resonator 22, 23, 24, 25 are etched on the metal ground 8, 12, 16 and 20 of the four antenna units near the center. The size of the split-ring resonator is 4.6 mm×4.6 mm, wherein the inner ring is 4 mm×4 mm; the width between the inner and the outer ring is 0.4 mm; the width of the opening is 0.2 mm. The four split-ring resonators are on the diagonals of the four-unit MIMO antenna. FIG. 8 is the simulated S parameters graph of the four-unit MIMO antenna shown in FIG. 7, which shows the amplitudes of $S_{21}$, $S_{31}$ and $S_{41}$ at frequencies (7 GHz-8 GHz) are decreased obviously and the unit separation is improved effectively after the split-ring resonators are included.

The present invention provided a wideband antenna for 5G, which is convenient for integration and processing, wherein based on the antenna a double-unit MIMO antenna is provided by crossing the polarized directions orthogonally. Furthermore, a four-unit MIMO antenna is proposed by introducing the metamaterial units. The antenna features in changeable unit number according to different requirements, high terminal separation, decoupling structure with low influence on the antenna and so on. The antenna is able to be widely applied in small mobile communication devices. The design method of the antenna is applicable to other multi-frequency and wideband antenna and provides a new design concept for the developing of novel miniature MIMO antenna in different frequency band.

What is claimed is:

1. A miniature wideband antenna for 5G ($5^{th}$ generation mobile networks), comprising: a dielectric substrate, a coplanar waveguide feed structure on a front of the dielectric substrate, a main radiator, a second radiator, a third radiator and a first radiator on a back of the dielectric substrate, wherein the coplanar waveguide feed structure comprises a feed line and a metal ground;

the metal ground is a wrap-around structure with a pentagon in a middle;

the main radiator is a deformed rectangle monopole antenna, a bottom of which is an inverted trapezoid connected to the feed line; a top of the monopole antenna is a rectangle structure with ladder-shaped grooves;

the first radiator is an isosceles trapezoid set on the back of the dielectric substrate; a short side of the isosceles trapezoid is near and parallel to a bottom of the metal ground;

the second and the third radiators are parallelograms placed symmetrically beside two sides of the main radiator; bottoms of the second and the third radiators are near and parallel to the metal ground; at an obtuse angle of a bottom of each of the parallelograms there is a groove in a right trapezoid shape.

2. The miniature wideband antenna, as recited in claim 1, wherein the pentagon in the middle of the wrap-around metal ground is formed by a rectangle and an isosceles triangle.

3. The miniature wideband MIMO antenna, as recited in claim 1, wherein a miniature wideband antenna is an antenna unit, two of which are placed orthogonally to form a double-unit MIMO antenna.

4. The miniature wideband MIMO antenna, as recited in claim 1, wherein a miniature wideband antenna is an antenna unit, four of which are placed in one plane; every two antenna units are placed symmetrically along each of two diagonals; the two antenna units along one of the diagonals are placed face-up and the rest two antenna units are placed face-down; the four antenna units form a four-unit MIMO antenna.

5. The miniature wideband MIMO antenna, as recited in claim 4, wherein on the metal ground of each of the four-unit MIMO antenna units there is a rectangle split-ring resonator placed near a center of the overall antenna; axes of symmetry of the four split-ring resonators is on the diagonals of the four-unit MIMO antenna.

* * * * *